US010520190B2

(12) United States Patent
Maino et al.

(10) Patent No.: US 10,520,190 B2
(45) Date of Patent: Dec. 31, 2019

(54) DEVICE FOR THE IGNITION/RE-IGNITION OF THE FLAME FOR A GAS BURNER, FOR EXAMPLE IN A COOKTOP, AND CORRESPONDING METHOD

(71) Applicant: ILLINOIS TOOL WORKS INC., Glenview, IL (US)

(72) Inventors: Nicola Maino, Varese (IT); Daniele Pianezze, Varese (IT); Gianluca Gaudio, Varese (IT); Daniele Turetta, Varese (IT); Bruno Luca, Monza Brianza (IT)

(73) Assignee: Illinois Tool Works Inc., Glenview, IL (US)

( * ) Notice: Subject to any disclaimer, the term of this patent is extended or adjusted under 35 U.S.C. 154(b) by 82 days.

(21) Appl. No.: 15/511,279

(22) PCT Filed: Jun. 18, 2015

(86) PCT No.: PCT/US2015/036486
§ 371 (c)(1),
(2) Date: Mar. 15, 2017

(87) PCT Pub. No.: WO2016/043821
PCT Pub. Date: Mar. 24, 2016

(65) Prior Publication Data

US 2017/0248310 A1 Aug. 31, 2017

(30) Foreign Application Priority Data

Sep. 18, 2014 (IT) ..... TO2014A0737

(51) Int. Cl.
*F23Q 3/00* (2006.01)
*F23N 5/12* (2006.01)

(52) U.S. Cl.
CPC ..... *F23N 5/123* (2013.01); *F23N 2027/28* (2013.01); *F23N 2027/36* (2013.01)

(58) Field of Classification Search
CPC ..... F23N 5/123
(Continued)

(56) References Cited

U.S. PATENT DOCUMENTS 3,348,104 A * 10/1967 Zielinski ..... F23N 5/022 250/206
3,836,857 A * 9/1974 Ikegami ..... F23N 5/123 307/650

(Continued)

OTHER PUBLICATIONS

Search Report for IT Application No. TO20140737; dated May 7, 2015.

(Continued)

*Primary Examiner* — Vivek K Shirsat
(74) *Attorney, Agent, or Firm* — Boyle Fredrickson, S.C.

(57) ABSTRACT

A device for igniting/re-igniting the flame for a gas burner, for example for a cooktop, is capable of receiving a supply voltage from a supply source. The device is furthermore configured for receiving a signal representing the presence of the flame. The flame ignition/re-ignition device is configured for activating a spark activation circuit (70) configured for generating sparks for igniting the flame when the signal representing the presence of the flame indicates absence of flame, and interrupting the generation of sparks when the signal indicates presence of flame. Furthermore, the flame ignition/re-ignition device comprises an anti-inversion circuit (40) configured for uncoupling the flame ignition/re-ignition device from the direction of insertion of a supply plug for the device into a domestic power outlet, making the device insensitive to the polarity adopted in the connection between the plug and the power outlet.

6 Claims, 14 Drawing Sheets

(58) Field of Classification Search
USPC ..... 431/69–72, 18, 264
See application file for complete search history.

(56) References Cited

U.S. PATENT DOCUMENTS 4,689,006 A 8/1987 Gann
6,729,873 B2 * 5/2004 Neufield ..... F23D 14/725
431/12

OTHER PUBLICATIONS

International Search Report or Application PCT/US2015/036486; dated Aug. 26, 2015.

* cited by examiner

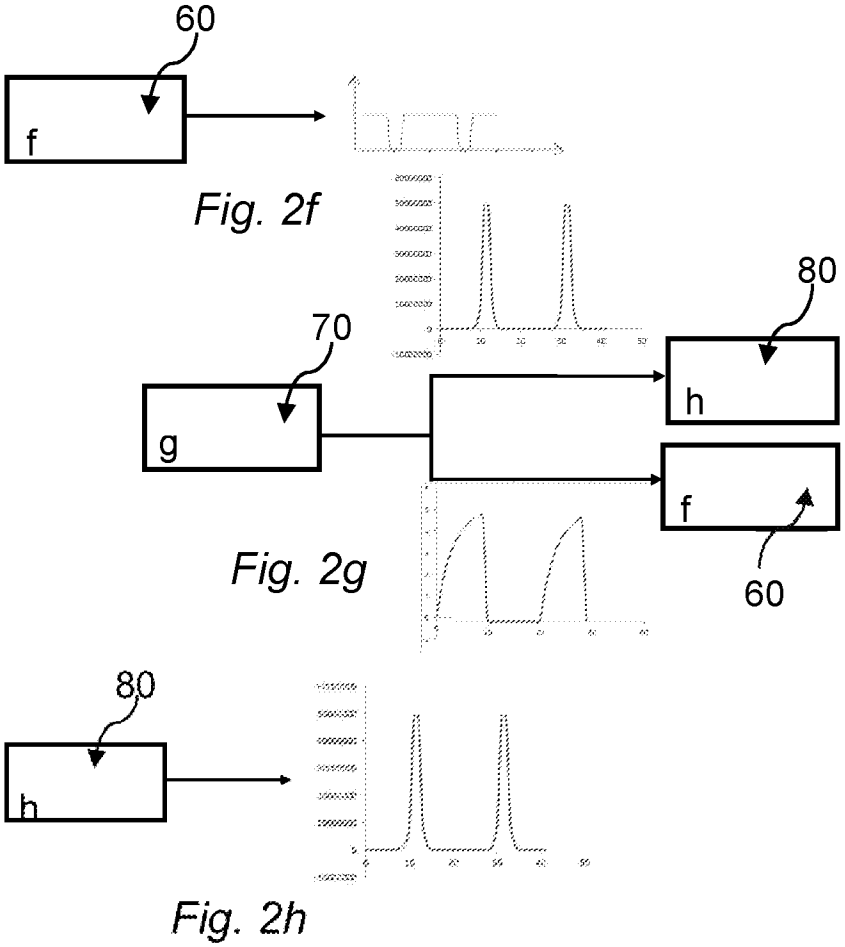
60
f
Fig. 2f
70
g
Fig. 2g
80
h
60
f
80
h
Fig. 2h
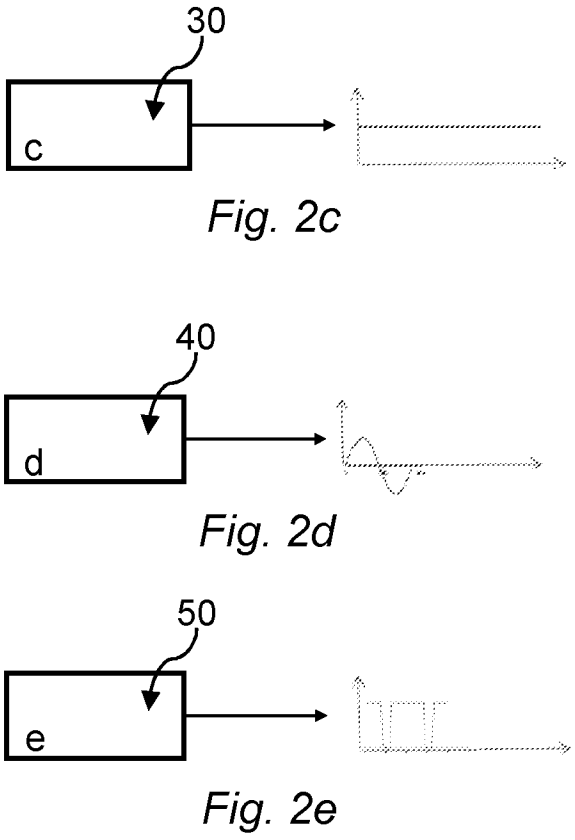
30
c
Fig. 2c
40
d
Fig. 2d
50
e
Fig. 2e

60

DEVICE FOR THE IGNITION/RE-IGNITION OF THE FLAME FOR A GAS BURNER, FOR EXAMPLE IN A COOKTOP, AND CORRESPONDING METHOD

TECHNICAL FIELD

The present description refers to solutions for controlling the ignition/re-ignition of the flame in gas burners used, for example, in cooktops.

The present description refers furthermore to solutions which make it possible to uncouple the wiring-up of the cooktop from the polarity of the connection between power outlet and plug.

TECHNOLOGICAL BACKGROUND

In applications for cooktops, flame detection circuits using the current rectification method have been widely used for some time. With these known solutions, it is necessary at the stage of installing the cooktop to respect the polarity of the power outlet when wiring up the cooktop to the domestic power outlet, in order to guarantee the capacity for flame detection in all operating conditions of the control imposed by the market.

To this end, some constructors have recourse to or specify the use of transformers, in which one end of the secondary circuit is connected to the earth of the domestic network.

This solution is not, however, a low-cost solution, either in economic terms or in terms of space.

In the re-ignition devices currently on sale, the momentary absence of the flame, for example because of a gust of wind or liquids overflowing from a pan placed on the cooktop and momentarily interrupting a portion of the flame, leads immediately to the control producing sparks for reinstating the flame.

This behavior is in itself pointless from a functional point of view, since it is not necessary to reinstate a flame which is already present, and it is furthermore annoying for the user to hear the sparks being triggered, as well as causing wear on the sparkplugs which are pointlessly stressed.

In some re-ignition devices currently on sale, the momentary absence of the flame leads immediately to the device control producing sparks for reinstating the flame for a time determined by the hardware and not parametrizable. This timing is therefore not customizable according to the needs of the manufacturer of the cooktops, except by modifying the hardware.

Furthermore, these controls treat in the same way both conditions of first ignition and conditions where the flame has been disturbed, making the re-ignition device slow in conditions of first ignition.

Various re-ignition systems are furthermore known, such as the examples described in the following documents: U.S. Pat. Nos. 4,689,006, 5,439,374, 5,472,336, 6,985,080 B2, and U.S. Pat. No. 6,729,873 B2.

All these re-ignition systems, however, suffer from a series of disadvantages, like those indicated above.

OBJECT AND SUMMARY

The inventors have observed that a device is needed for flame ignition/re-ignition which overcomes one or more of the disadvantages described above.

With a view to achieving the above object, the invention has as its subject a flame ignition/re-ignition device having the characteristics specified in claim 1. The invention also concerns a corresponding method. Further advantageous characteristics of the invention form the subject of the dependent claims.

The claims form an integral part of the technical teaching provided here in relation to the invention.

In various embodiments the flame ignition/re-ignition device for a cooktop is capable of receiving a supply voltage from a supply source and is configured for receiving a signal representing the presence of the flame. The flame ignition/re-ignition device is configured for activating a spark activation circuit configured for generating sparks for igniting the flame when the signal representing the presence of the flame indicates absence of flame, and interrupting the generation of sparks when the signal indicates presence of flame.

In various embodiments the flame ignition/re-ignition device comprises an anti-inversion circuit configured for uncoupling the flame ignition/re-ignition device from the direction of insertion of a supply plug for the device into a domestic power outlet, making the device insensitive to the polarity adopted in the connection between the plug and the power outlet.

In various embodiments the anti-inversion circuit comprises a resistive divider sized in such a way as to ensure that the output provided through a third central terminal is as different as possible from the signals which it receives as inputs on the two input terminals from the supply source.

In various preferred embodiments the device comprises a flame detection circuit to detect the presence of the flame. The flame detection circuit is configured for generating the above signal representing the presence or otherwise of the flame. In particular the anti-inversion circuit comprises a resistive divider sized in such a way as to ensure that the output provided as output through the third central terminal and carried as input to the flame detection circuit is equal to half the supply voltage provided by the supply source.

In various embodiments the cooktop comprises at least one knob for adjusting the delivery of the gas. The ignition/re-ignition device comprises furthermore a circuit for capturing the position of the knob (20). In particular the knob is movable between an open and a closed position, and the circuit for capturing the position of the knob is configured for generating a signal representing the position of the knob in which the signal representing the position of the knob is capable of activating said spark activation circuit.

Preferably, in various embodiments the device comprises furthermore a control logic circuit configured for interpreting and processing the signals coming from the circuit for capturing the position of the knob, from the flame detection circuit and from the spark activation circuit. The control logic circuit is configured for controlling the spark activation circuit depending on the processing of the signals received as input.

In various embodiments the control logic circuit is capable of controlling the operation of the spark activation circuit for generating sparks only when:

- the signal generated by the circuit for capturing the position of the knob indicates an open position for the knob, and
- the signal generated by the flame detection circuit indicates absence of flame for a time greater than a pre-established time.

In various embodiments the control logic circuit is configured for recognizing and discriminating a condition of disturbed flame from a condition of absent flame, enabling the spark activation circuit only when the flame is absent for a time greater than a pre-established time, so as to eliminate pointless flame re-ignitions caused by the condition of disturbed flame.

In various embodiments the spark activation circuit is configured for generating sparks at substantially constant frequency and independent of the voltage and frequency of the supply source.

In various embodiments the spark activation circuit is configured for generating sparks at a frequency settable through the selection of the circuit parameters comprised in the flame ignition/re-ignition device.

In various embodiments the spark activation circuit is configured for modifying the frequency of the spark for triggering the flame, depending on the time spent in the attempt to trigger the flame, increasing the frequency as the time spent increases.

In various alternative embodiments the control logic circuit processes the signal generated by the flame detection circuit and the signal generated by the spark activation circuit to provide the output voltage from the anti-inversion circuit as input voltage to an electrode block.

The present description refers furthermore to a method for managing ignitions/re-ignitions according to claim 12.

The proposed solution therefore makes it possible to obtain control of ignitions/re-ignitions and achieve independence from the polarity of the wiring-up of the cooktop to the domestic power outlet, making installation operations faster and simpler.

BRIEF DESCRIPTION OF THE DRAWINGS

One or more of the embodiments will now be described, purely by way of non-limiting example, with reference to the attached drawings, in which.

DETAILED DESCRIPTION

Figure 1:
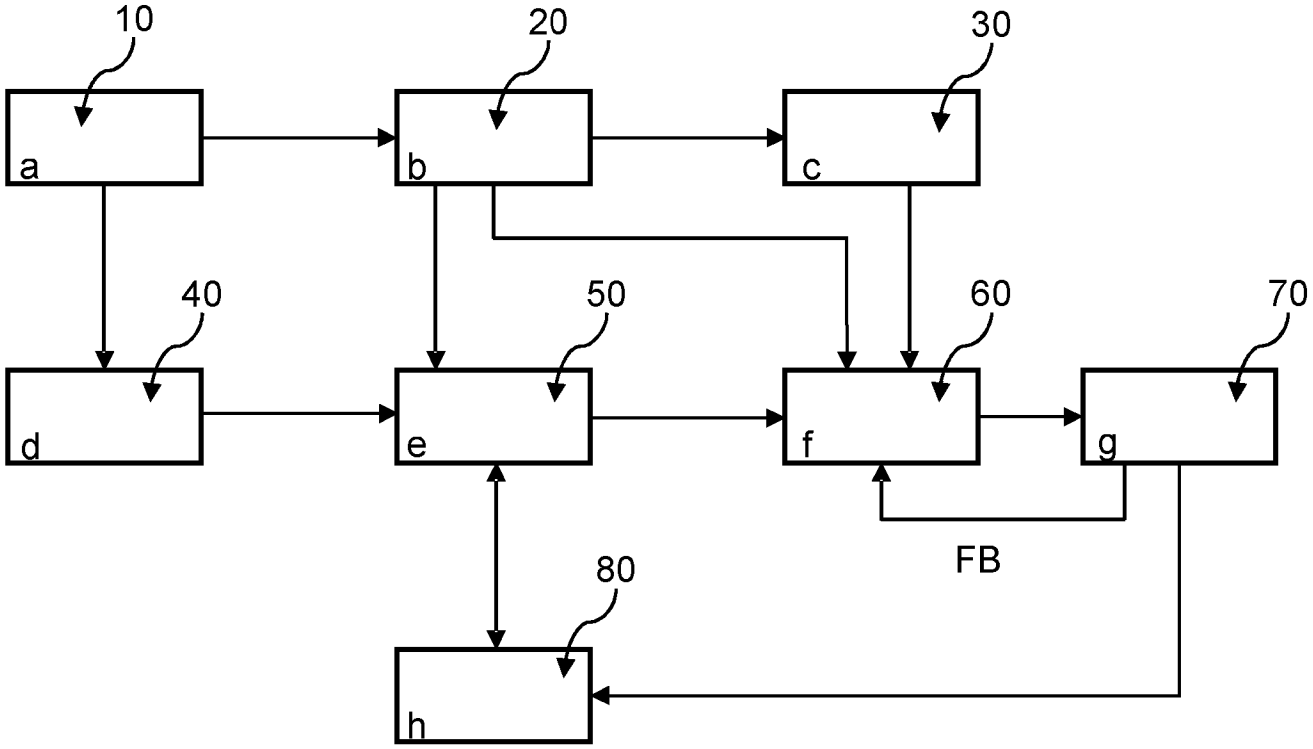
FIG. 1 shows an embodiment of the block scheme of the re-ignition device, highlighting the iterations between the various blocks or stages which make up the device.

In the description below, various specific details are illustrated aimed at a thorough understanding of examples of one or more embodiments. The embodiments may be realized without one or more of the specific details, or with other methods, components, materials etc. In other cases, known structures, materials or operations are not shown or described in detail, to avoid obscuring various aspects of the embodiments. The reference to "an embodiment" in the sphere of this description is intended to indicate that a particular configuration, structure or characteristic described in relation to the embodiment is comprised in at least one embodiment. Therefore, phrases such as "in one embodiment", that may be present in various places in this description, do not necessarily refer to the same embodiment. Furthermore, particular conformations, structures or characteristics may be combined in an appropriate way in one or more embodiments.

The references used here are only for convenience and do not therefore define the sphere of protection or the scope of the embodiments.

As mentioned above, the present description provides solutions for an ignition/re-ignition control device for cooktops. In particular, in various embodiments the control device, through a circuit of flame rectification type, detects the presence or otherwise of the flame and takes steps, when appropriate, to activate a voltage generating circuit capable of providing the ignition sparkplugs with the energy needed for the production of the spark necessary for triggering the flame.

The ignition/re-ignition device here described is capable of operating independently of the polarization of the plug in the domestic power outlet, without the use of transformers, thus allowing a considerable reduction in the costs of manufacture, while service/technical assistance problems furthermore favor miniaturization with all the positive aspects connected with it.

In various embodiments, the control device is capable of recognizing and discriminating a condition of disturbed flame from a condition of absent flame, enabling the ignition/re-ignition circuit, i.e. the devices capable of creating the sparks necessary for triggering the flame, only when it is really necessary and desired (i.e. in conditions of ascertained and real absence of flame).

In various embodiments the control circuit can produce sparks for triggering the flame at an almost constant frequency, independent of the voltage and frequency of the supply voltage (or at least in a window of predefined values).

In particular, in the embodiment considered, the control circuit furthermore makes it possible to unambiguously estimate the useful life of the sparkplugs which create the sparks for triggering the flame, as well as to determine the frequency depending on the requirements of the application.

For example, in various embodiments it is also possible to modify the frequency of the sparks according to the time spent in the attempt to produce the flame (a frequency which increases over time to increase the probability of triggering the flame).

In particular, in various embodiments considered, the control circuit reduces its own energy consumption when the presence of the flame is not required (for example when the gas tap is in the closed position). In this condition it is not therefore necessary to generate sparks for igniting the flame.

In various embodiments the control circuit achieves the recognition of the presence of a flame based on the flame's own capacity for current rectification.

In more detail, in the embodiment considered, the control circuit functions whatever the polarity of the domestic power outlet. Therefore, at the installation stage, no particular attention is required when the operator wires up the cooktop to the domestic power outlet. For example, in the embodiment considered, it is possible to uncouple the operation of the control device from any errors in wiring the domestic system (for example, in the United States the outlet could be polarized with neutral and line inverted).

In various embodiments the control circuit makes it possible to obtain the above advantages compared with known solutions thanks to the characteristics of an anti-inversion circuit created with low-cost components.

In various embodiments the control system according to the present description furthermore has the distinctive feature of adapting its own reaction time depending on the actual flame conditions.

In general, sparks represent a potential source of disturbance for the controls and the different devices connected to the electrical network. It is therefore advantageous to reduce the number of unnecessary sparks.

In various embodiments, the control circuit according to the present description is attached to a gas cooktop to provide the spark needed for igniting/re-igniting the flame.

Such control devices can be referred to as "re-ignition devices". In particular, the control circuit detects the presence of the flame by exploiting the flame's property of ionization, which makes it electrically equivalent to a diode in series with a resistance.

In various embodiments the control circuit is rendered insensitive to and independent of the polarity of the power outlet, making the operation of connecting the cooktop to the domestic power outlet faster and less complicated. This advantage is obtained in all operating conditions imposed by the market (voltage and/or frequency).

In various embodiments the control circuit can be divided into several stages or blocks, each of which performs a very precise function.

In particular, in various embodiments the control circuit can comprise the following stages:

a) Supply,
b) Knob position capture,
c) Control logic supply,
d) Anti-inversion,
e) Flame recognition,
f) Control logic,
g) Spark activation, and
h) Electrodes.

In particular, different constructors can choose between two different embodiments for the control of the individual burners in a cooktop.

The first embodiment requires a single device for control of the ignition of a number "n" of burners (with n=2, 3, 4, 5, 6), in which a single device controls all the burners. This is a solution which optimizes costs.

The second embodiment requires each burner to have associated with it an ignition control device, a solution with a higher cost, but which allows redundancy and greater security against malfunctions. In this case, if one of the ignition control devices were to break down, the other burners would anyway remain usable.

Currently in cooktops with a plurality of burners when one of the knobs for delivering gas is open, in the absence of a flame, the ignition/re-ignition device activates the spark generating circuit and all the electrodes (each associated with a single burner) generate a spark. Naturally the flame will light only on the burner associated with the knob in the open position.

Furthermore, the re-ignition device here described for use in a cooktop can be used in any product which uses a gas burner connected to the electrical network, such as for example a gas boiler.

FIG. 1 shows the various blocks which make up the device and the connections required between the various blocks for the exchange of messages and/or commands.

In particular, the supply block 10 provides energy to the blocks for capturing the position of the knob 20 and anti-inversion block 40. The flame recognition block 50 receives as input the signals generated by the knob position capture blocks 20, the anti-inversion block 40, and the electrodes block 80, and generates control signals directed towards the control logic block 60 and the electrodes block 80. The knob position capture block 20 furthermore generates signals which it sends to the control logic supply block 30 and to the control logic block 60. The control logic block 60 furthermore receives a signal directly from the control logic supply block 30. The control logic block 60 generates a control signal for the spark activation block 70, which generates a feedback signal FB directed towards the control logic block 60. Finally, the spark activation block 70 generates a control signal for the electrodes block 80.

In more detail, a description will be given below of the functions of each block or stage with the aid of FIGS. 2 and 3.

Figure 2B:
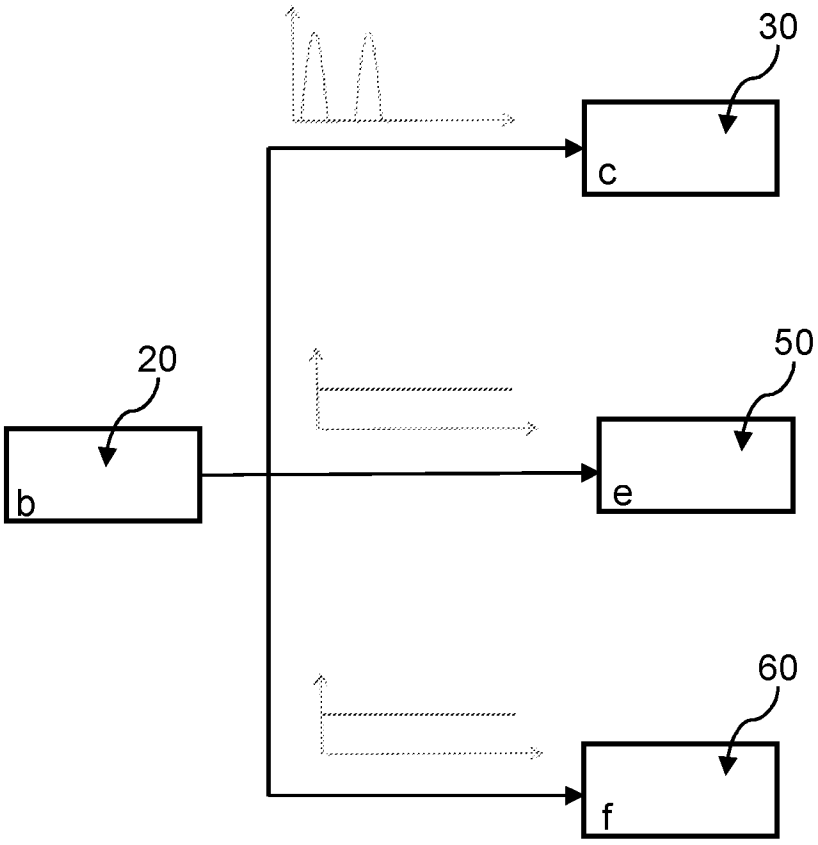
FIG. 2 (FLAME ABSENT) show an example of signals which each of the blocks of FIG. 1 provides to the recipient blocks, in the condition in which the flame is not present at the electrodes.
Figure 2A:
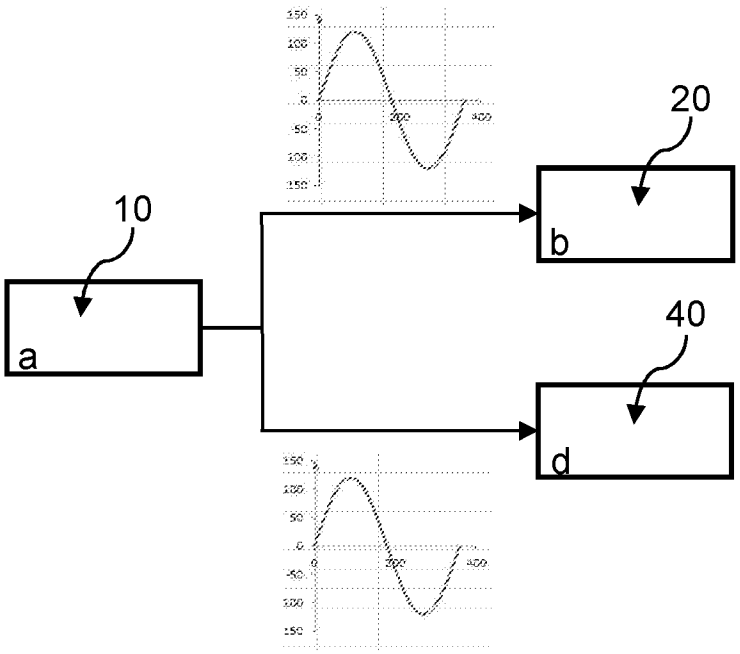
Figure 3B:
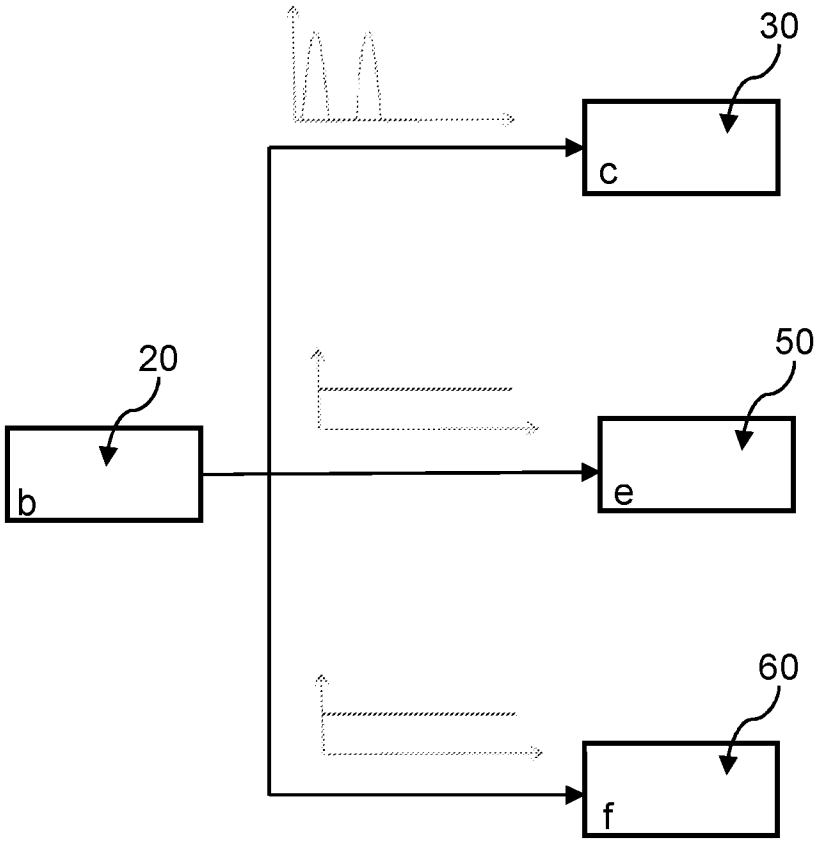
FIG. 3 (FLAME PRESENT) show an example of signals which each of the blocks of FIG. 1 provides to the recipient blocks, in the condition in which the flame is present at the electrodes.
Figure 3A:
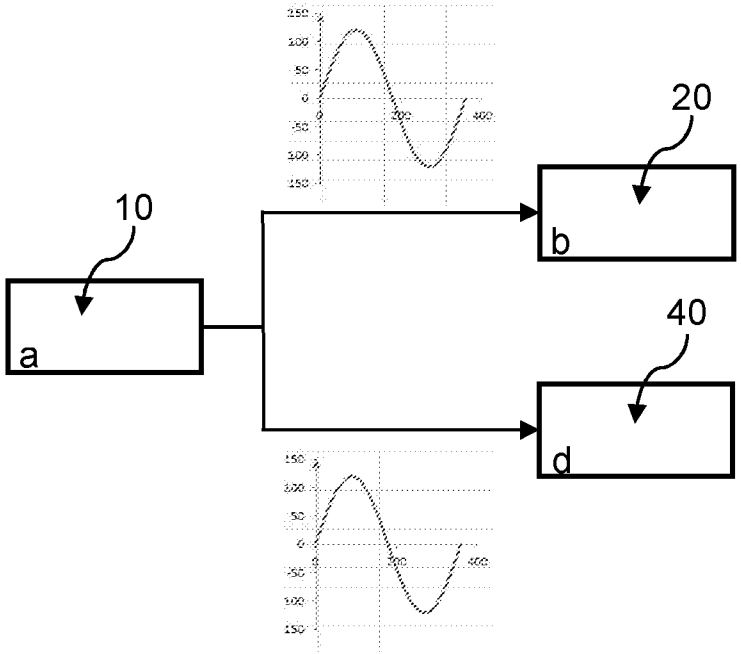
Figure 3F:
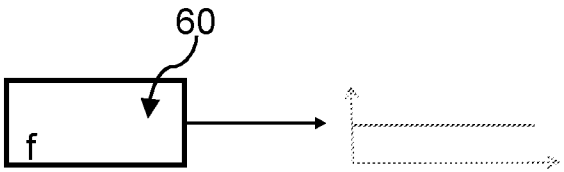
Figure 3G:
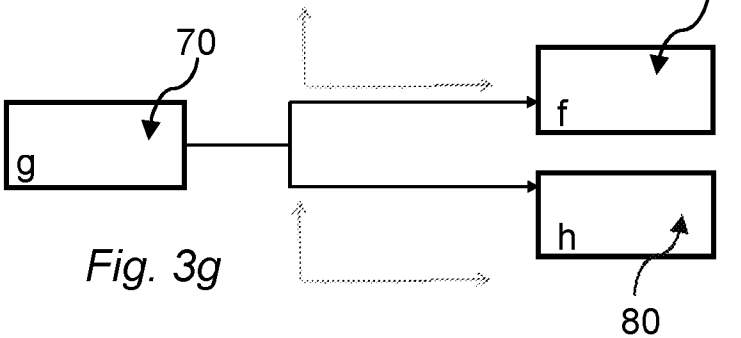
Figure 3H:
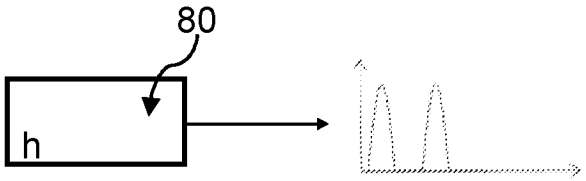

Stage 10: a) Supply:

Provides a first network signal for stage 20, b) Knob Position Capture, and a second network signal for stage 40, d) Anti-inversion; both signals are sinusoidal AC signals. In one embodiment the AC signals can be for example 110 VAC and frequency 60 Hz signals. In particular, FIG. 2*a* shows the signals generated by supply block 10 in the condition of flame absent, while FIG. 3*a* shows the signals generated by supply block 10 in the condition of flame present.

Stage 20: b) Knob Position Capture:

Captures the open/closed status of the knob. In the first case (knob open), block 30, c) Control logic supply, is not enabled, allowing the current saving previously mentioned. In the second case, (knob closed) the block allows the output from stage 50, e) Flame Recognition, to flow towards stage 60, f) control logic; in particular, FIG. 2*b* shows the signals generated by the knob position capture block 20 in the condition of flame absent, while FIG. 3*b* shows the signals generated by the knob position capture block 20 in the condition of flame present. In one embodiment the knob position capture block 20 can generate for example a first alternating AC sinusoidal signal with only the positive half-waves for the control logic supply block 30, a second DC signal (for example 3V-5V DC) for the flame recognition block 50 and a third DC signal (for example 3V-5V DC) for the logic control block 60.

Figure 3C:
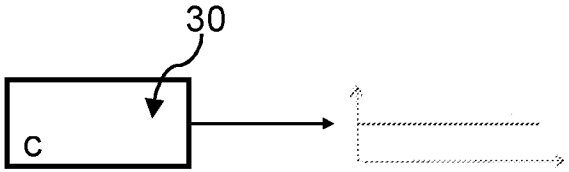
Figure 3D:
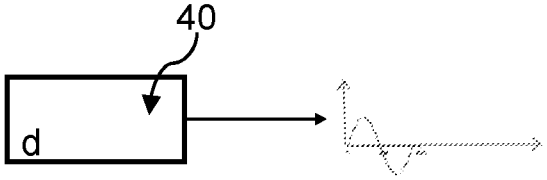
Figure 3E:
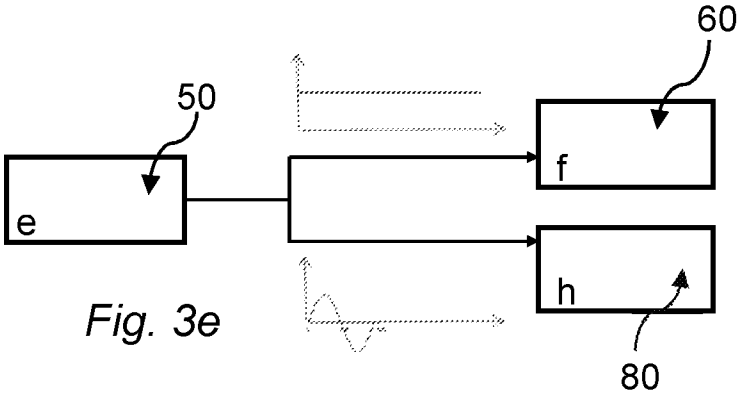

Stage 30 c) Control Logic Supply:

This stage 30, if enabled, is concerned with generating the supply necessary for operating stage 60, f) control logic, and the hardware that interfaces with it. In particular, FIG. 2*c* shows the signal generated by block 30, control logic supply, in the condition of flame absent, while FIG. 3*c* shows the signal generated by block 30, control logic supply, in the condition of flame present.

Stage 40 d) Anti-Inversion:

Stage 40 represents the principal modification introduced by the proposed solution in the present description compared with known systems. The anti-inversion stage provides as output an alternating sinusoidal signal to stage 50 e) Flame Recognition. For example, this sinusoidal signal can be a 60V signal with frequency 60 Hz (see FIGS. 2*d* and 3*d*). This signal, irrespective of the direction of insertion of the plug into the domestic power outlet, is always at a higher potential compared with the earth reference of the electrode of the similarly named block h) Electrodes (this was not possible in earlier systems without a transformer). This characteristic makes it possible for stage 80, h) Electrodes to deduct current from stage 50, e) Flame recognition, when the latter is present on the sparkplug electrode. The presence of stage 40 Anti-Inversion makes it possible for the installer of the cooktop to be uninterested in respecting a particular polarity for inserting the plug in the domestic power outlet. It is important also to note that this stage is unrelated to the ASIC type of control logic, ("Application-Specific Integrated Circuit" microcontroller, etc.).

Stage 50 e) Flame Recognition:

Block 50 identifies the presence of the flame at the burner through a signal sent by block 80, h) Electrodes and communicates the above information to stage 60, f) Control Logic. This stage furthermore communicates to stage 80, h) Electrodes, the signal from stage 40, d) Anti-inversion. In conditions of absence of flame, in addition to what has just been said, this stage 50 makes use of the alternating AC sinusoidal input signal coming from block 40, d) Anti-inversion, and produces as output a DC impulse signal at very low voltage directed towards stage 60, f) Control Logic, (see FIGS. 2*e* and 3*e*). The recognition of the presence of the flame is made possible by the following mechanism: the ionization of the flame produces a negative voltage offset in the stage 50 under consideration; this offset prevents the execution of the impulse signal which is capable of enabling the control logic for generating the spark, and replaces it with a continuous DC signal at very low voltage.

Stage 60 f) Control Logic:

Interprets the signals coming from stages 20, b) Knob position capture, 50, e) Flame recognition, and 70, g) Spark activation. The result of the processing of the inputs allows control of stage 70 g) Spark activation through the signal shown in FIG. 2*f* or 3*f*.

Stage 70, g) Spark Activation:

Following reception by stage 60, f) Control logic, of the enablement signal, stage 70, g) Spark Activation consents to the activation of the spark between the electrode of the sparkplug and the electrode of the burner, both positioned on the cooktop; in the case of absence of flame, block 70 generates a DC signal, corresponding to the charging/discharging of the condenser, for block 60 Control logic (see FIG. 2*g*) and a 220V 3 Hz impulse signal directed towards the electrodes block 80 (see FIG. 2*g*).

Stage 80, h) Electrodes:

Stage 80 performs the task of physically producing the spark and contributes with stage 50, e) Flame Recognition, to producing the input signal needed for stage 60, f) Control logic, which specifies the presence/absence status of the flame. When the flame is absent at the sparkplug electrode, this block is inoperative. When the flame is present at the sparkplug electrode, part of the current coming from the input to stage 40, d) Anti-inversion is deducted, but only in the positive polarity of the signal. This makes it possible to obtain a negative offset in stage 50, e) Flame recognition. In the absence of a flame an impulse signal is generated at the sparkplug electrode, for example 15 kV and 3 Hz. In the absence of a flame, an impulse signal is generated at the sparkplug electrode, for example 12 VAC and 60 Hz. See FIGS. 2*h* and 3*h*.

The presence of the flame rectifies the low voltage signal coming from block 70 Spark activation. This signal produces a current whose mean value generates the negative voltage offset in stage 50 Flame recognition. All this inhibits the generation of the impulse signal of absence of flame directed towards block 60.

Figure 4:
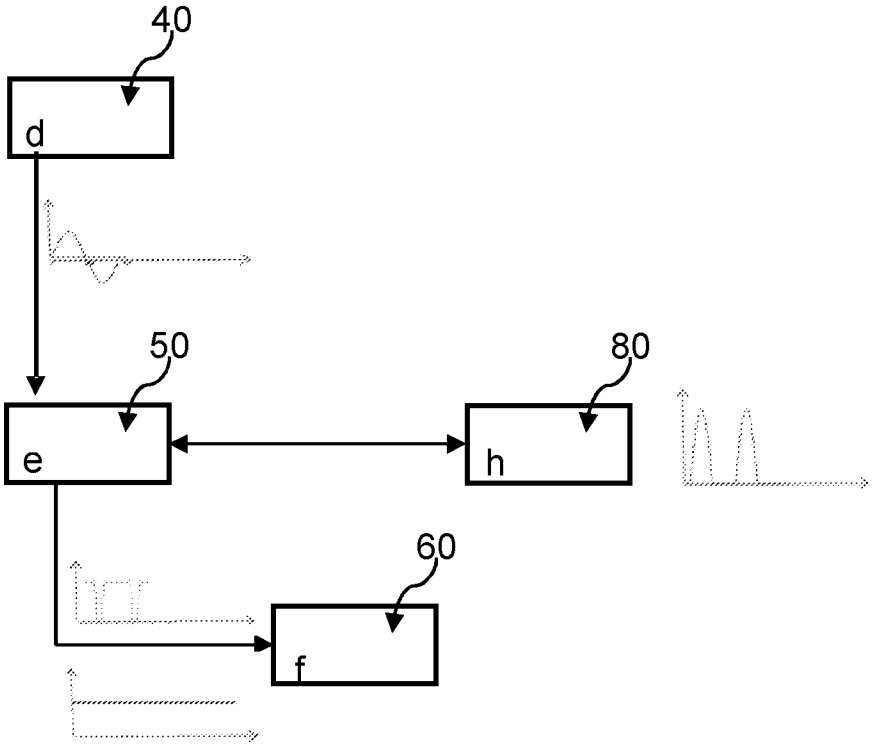
FIG. 4 (SCHEME OF PRINCIPLE OF THE INVENTION) shows an embodiment of the re-ignition device according to the present description.

With reference to FIG. 4, stage 40 Anti-inversion ensures an input signal to stage 50 Flame recognition with a potential greater than that of the earth terminal, irrespective of the direction of insertion of the plug of the re-ignition control device into the domestic power outlet. This difference in potential is necessary for producing the flame current when the flame is present at the burner electrode. The flame enables the ionization of the gas and allows the current to pass through it in a single direction. The equivalent electrical model of the flame is a bipole made up of a resistance of about 10 megohm in series with a diode. The flame current is deducted from block 50 Flame recognition in a single direction, causing a negative offset. As has already been said, the flame current is unidirectional and runs only from the electrode towards earth through the flame. This current is substantially given by the relationship between the mean voltage at the electrode and the resistance of the flame.

Examples of circuit realizations of the stages listed above will now be described in more detail.

Block 10 of Stage a) Supply

Figure 5:
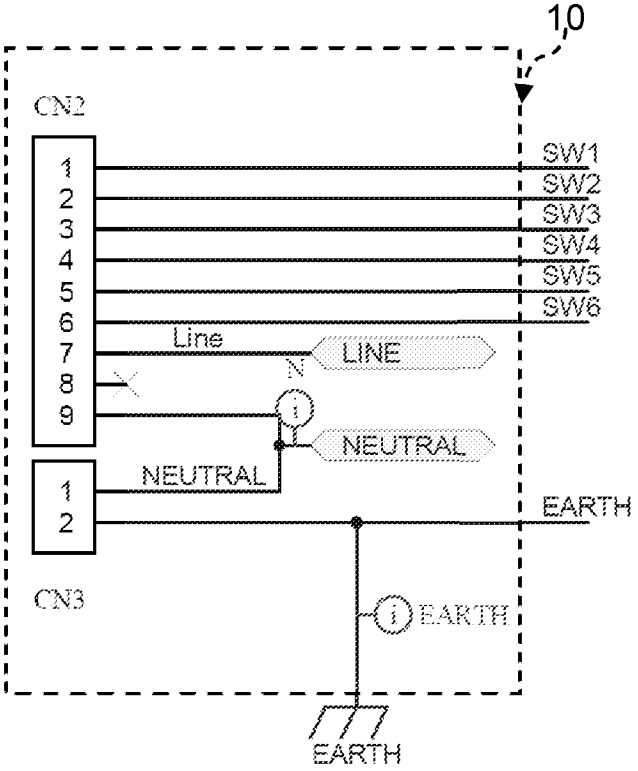
FIG. 5 (ELECTRICAL SUPPLY SCHEME) shows an embodiment of the electrical scheme of the circuit which realizes block a) Supply.

As illustrated in FIG. 5, it can be seen how the domestic electrical network must be connected through connectors CN2 and CN3 to the control device (without the need to respect the polarity of the power outlet).

The Line, Neutral and Earth signals are propagated in the electrical scheme through the respective labels LINE, NEUTRAL, EARTH. Connector CN2 furthermore carries the positions to which to connect the Line signal coming from the individual knobs when these are in the position for delivering gas.

For example, SW1 refers to the line coming from knob 1, SW2 to knob 2 and so forth.

The control device here described is realized for a six-ring cooktop, but the operating principle of the solution here described is independent of the number of rings on the cooktop.

Block 20 of Stage b) Knob Position Capture

Figure 6:
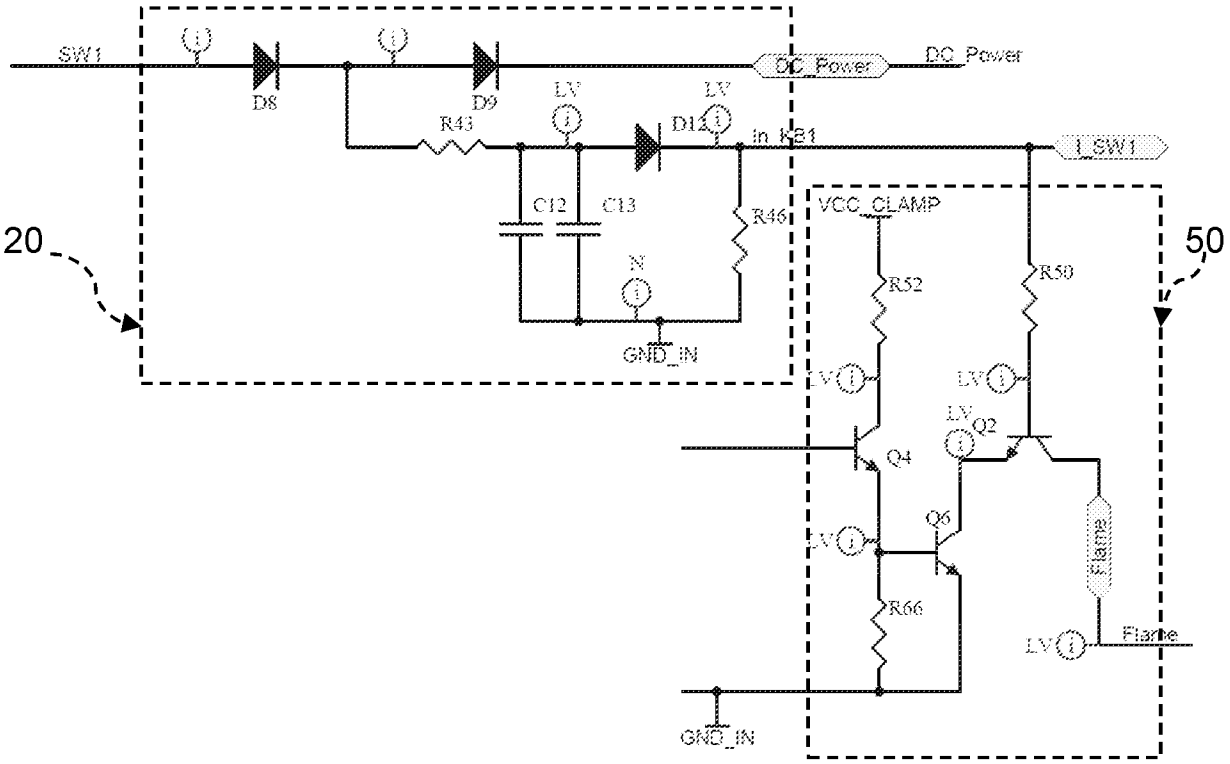
FIG. 6 (ELECTRICAL SCHEME OF KNOB POSITION CAPTURE) shows an embodiment of the electrical scheme of the circuit which realizes block b) Knob position capture.

To simplify the explanation of the realization scheme for this block 20, FIG. 6 illustrates only one of the circuits actually present. For example, only the signal coming from knob SW1 is examined. For the other signals coming from the other knobs SW2-SW6 the same considerations apply. As shown in FIG. 6, the line signal coming from SW1 is rectified by diodes D8 and D9 which provide stage 30, c) Control Logic Supply with a sinusoidal DC_Power signal deprived of the negative half-wave. This signal, identified with the reference DC_Power, is obtained by putting into logical OR the outputs of all the diodes D9 of the individual knob position capture stages (SW1 . . . SW6).

Diode D9 also performs the function of decoupling the different inputs of the knobs I_SW1, . . . I_SW6, making it possible to establish correctly in block 60, f) Control Logic, that each knob is in the gas delivery position.

The network is made up of the following components, a diode D8, a resistance R43, a condenser C12, a condenser C13, a diode D12 and a resistance R46; this circuit in fact makes it possible to obtain a continuous signal. This signal is also used to enable the output of stage 50, e) Flame Recognition, towards stage 60, f) Control Logic.

Circuit 50, e) Flame Recognition, constantly receives the signal FS_Supply, irrespective of the position of the knob. In consequence, the output of stage 50 must be taken into consideration only when the knob is actually in the gas delivery position.

What has just been described is realized through the enablement network consisting of a resistance R50 and a transistor Q2. When the network made up of R50 and Q2 is enabled, the output of a transistor Q6 indicates, for example through the Flame signal, the status of the flame at block 60, f) Control Logic. Conversely, when the network R50 and Q2 is not enabled, the output of Q6 does not alter the status of the Flame signal (normally forced to logical 1 by means of the pull-up resistance R18), thus avoiding at block 60, f) Control Logic, erroneous interpretations of flame absent when the knob is in the gas interruption position.

At the node which determines the value of the Flame signal, all the outputs of the transistors Q6 of every burner making up the cooktop converge, and realize a logical AND gate.

Block 30 of Stage c) Control Logic Supply

Figure 7:
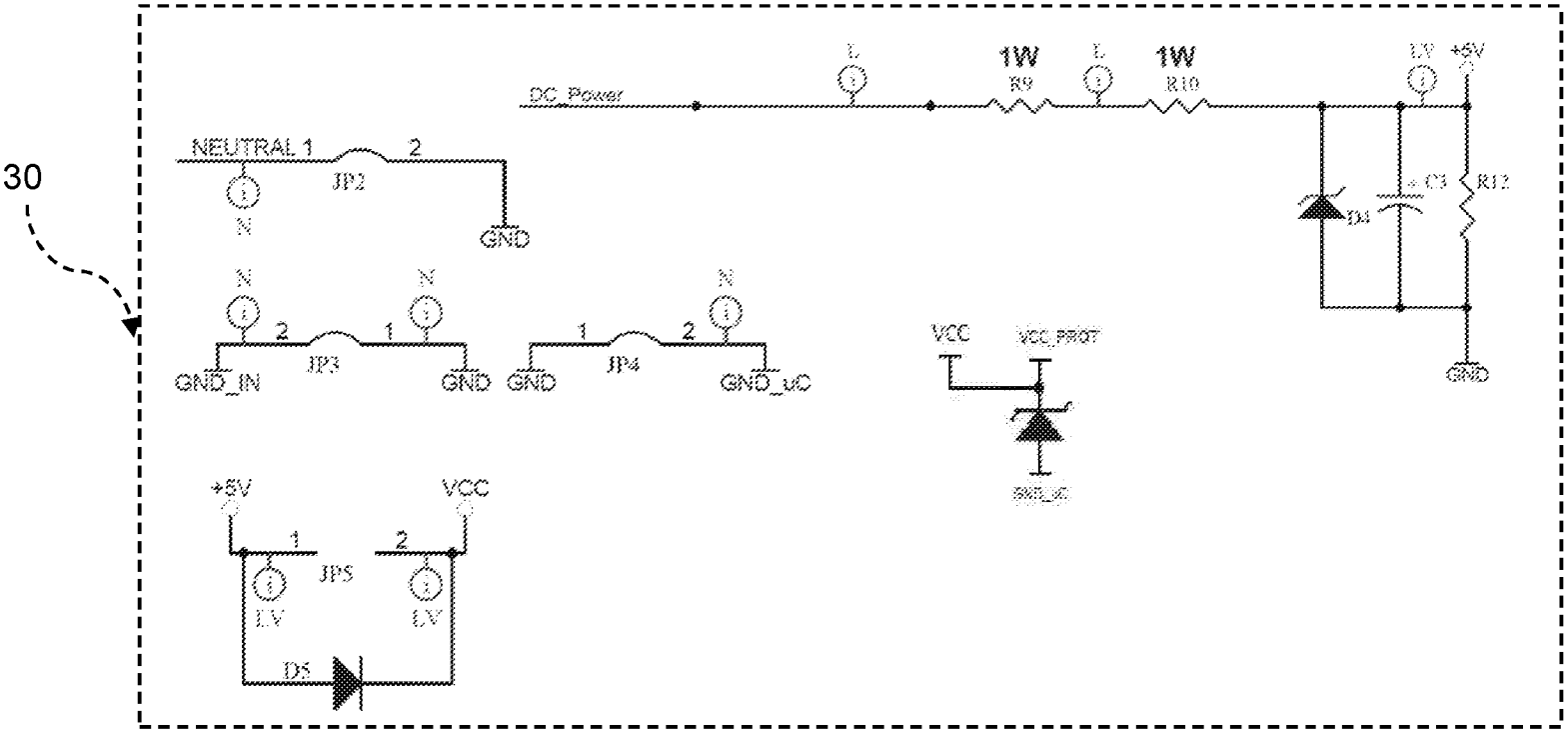
FIG. 7 (ELECTRICAL SCHEME, CONTROL LOGIC SUPPLY) shows an embodiment of the electrical scheme of the circuit which realizes block c) Control logic supply.

With reference to FIG. 7, the signal DC_Power, which is of single half-wave sinusoidal type, is integrated and stabilized through the network consisting of resistances R9, R10, a diode D4, a condenser C3, and a resistance R12. R9 and R10 perform the function of limiting the current; R12 is the discharge resistance.

The zener diode D4 determines the output voltage +5V of the circuit. Condenser C3 integrates the input signal to the network. The NEUTRAL signal acts as a reference or earth for the entire control network and is branched out to the various stages via the jumpers JP2, JP3, JP4, assuming the respective name of: GND, GND_IN, GND_UC; this is to indicate that at layout level the earths of the various stages of supply, inputs and control logic have been separated to improve the electromagnetic compatibility of the product.

Similar reasoning has been used for the signal +5V, which, via the diode D5, becomes VCC, which in fact is the supply to the control logic of the re-ignition device.

Diode D5 is furthermore used to prevent the network in question from charging the output stage of the control logic programmer.

Block 40 of Stage d) Anti-Inversion

Figure 8:
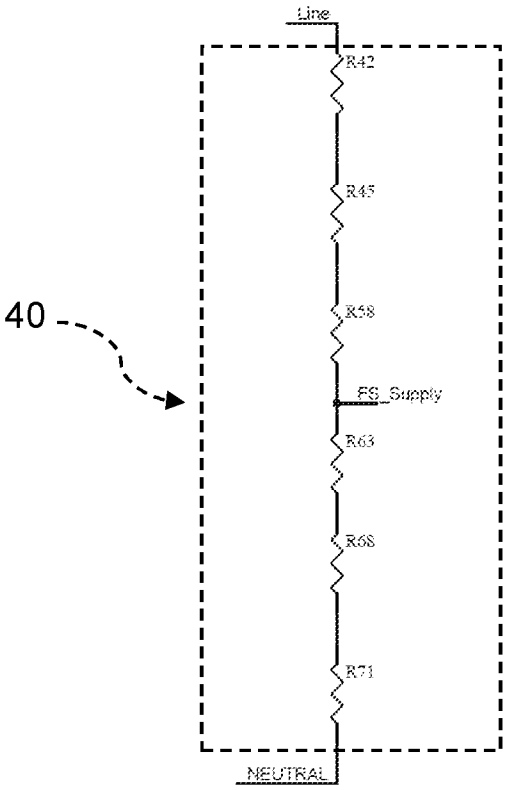
FIG. 8 (ELECTRICAL SCHEME OF ANTI-INVERSION) shows an embodiment of the electrical scheme of the circuit which realizes block d) Anti inversion.

With reference to FIG. 8, the electrical network consisting of the resistances R42, R45, R58, R63, R68, and R71 in fact creates a voltage divider, whose purpose is to provide the output FS_Supply with a signal which is as different as possible from the NEUTRAL signal and from the Line signal which it receives as inputs. This is irrespective of whether or not the polarity of the domestic power outlet is respected in the installation of the device here described.

For example, in the embodiment in question, the voltage divider is sized in such a way as to ensure that the output FS_Supply is preferably about, but not necessarily equal to, half the network voltage, irrespective of the polarity adopted.

This stage 40 makes it possible to uncouple the voltage FS_Supply provided to the filter network from the Line and NEUTRAL voltage. All this is through a simple resistive divider which comprises the aforementioned resistances R42, R45, R58, R63, R68 and R71, which cost little, and are not bulky.

The values of the resistances must be such as to guarantee the necessary current to the flame recognition stage 50. The resistances, at the same time, must be able to dissipate the power to which they are subjected.

Block 50 of Stage e) Flame Recognition

Figure 9:
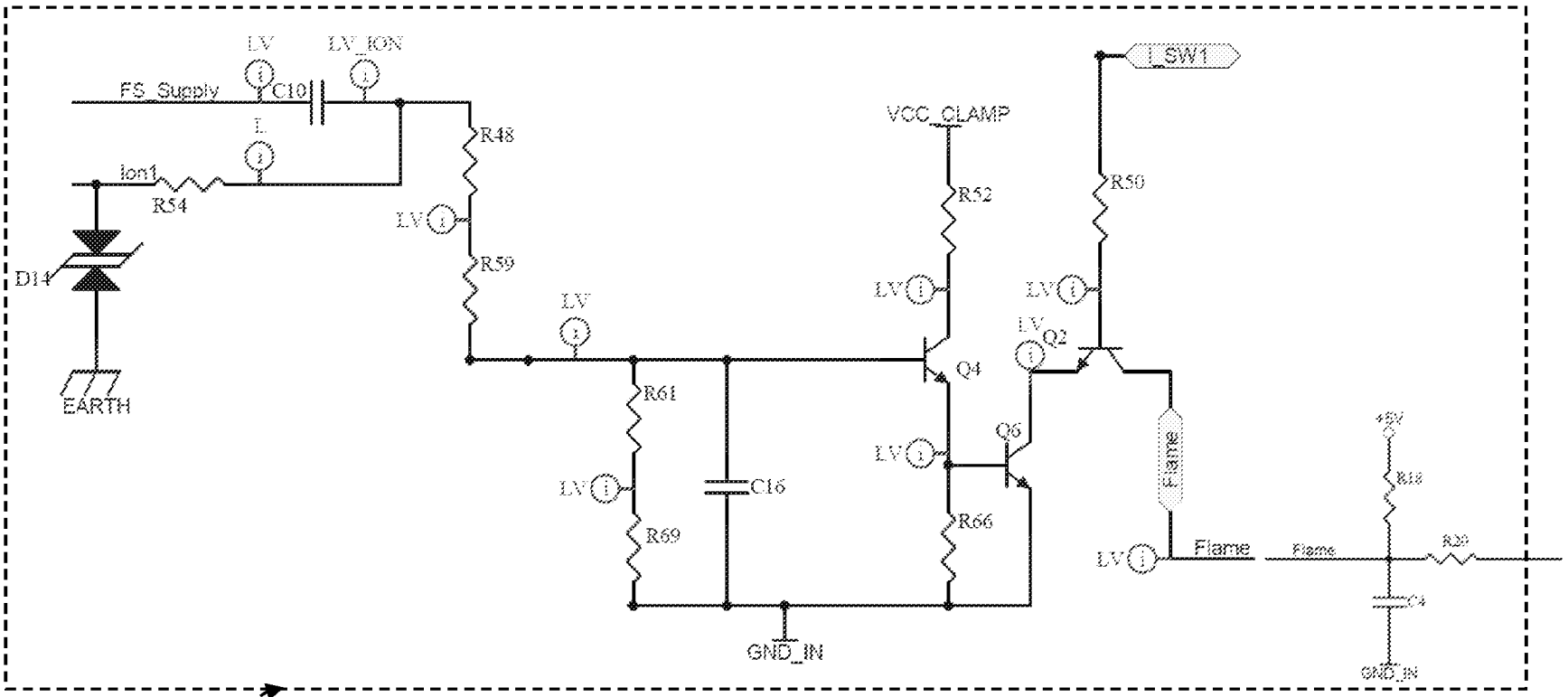
FIG. 9 (ELECTRICAL SCHEME OF FLAME RECOGNITION) shows an embodiment of the electrical scheme of the circuit which realizes block e) Flame recognition.

As illustrated in FIG. 9, the signal FS_Supply coming from stage d) Anti inversion is exploited to detect the presence or otherwise of the flame at the sparkplug electrode.

The latter is physically connected to stage 50 through the coil of the secondary circuit of the transformer, used for generating the sparks between the sparkplug electrode and that of the burner.

The coil in question is connected to this stage by means of a resistance R54, whose value creates the protection impedance required by the safety regulations. The diode D14 is concerned with reducing to about 350V the voltage coming from the transformer during the production of sparks, in such a way that the sparks do not damage the downstream hardware.

Assuming that the device's plug respects the polarity of the domestic power outlet, in the positive phase of the network signal, in the absence of a flame at the electrode, the branch consisting of resistance R54 is in fact floating and does not affect the rest of the circuit. The signal FS_Supply generates a saturation current in transistors Q4 and Q6, characterized by a very high gain.

The value of a condenser C16 determines the amplitude of the sinusoidal signal on the basis of transistor Q4, while resistances R48 and R59 limit the input current of the circuit. The saturation of transistor Q4 in turn permits the saturation of transistor Q6 when the knob relating to the flame input is in the gas delivery position.

In this case the current signal I_SW1 allows the transistors Q2 and Q6 to link the Flame signal to the value logical "0" (approximately 0.4V).

As has been said, the value of condenser C16 determines the amplitude of the sinusoidal signal on the basis of the transistor Q4 (which has a maximum value equal to VBE (Q4)+VBE(Q6)) and, therefore, the duty cycle of the Flame signal in output from this stage (Flame is fixed at +5V by means of resistance R18).

With respect to the previous condition, during the negative phase of FS_Supply, in the absence of a flame at the sparkplug electrode the transistor Q4 interdicts itself and resistance R66 restricts the input of transistor Q6 in this case to GND_IN, ensuring its interdiction.

All this leaves the signal I_Flame restricted to +5V through resistances R18 and R20.

Inverting the polarity of the plug in the power outlet changes nothing, as FS_Supply maintains its characteristics with respect to GND_IN, this time ensuring saturation of transistor Q6 in the negative phase of the network signal and the interdiction of transistor Q6 in the positive phase.

When the flame is present at the sparkplug electrode and the apparatus's plug respects the polarity of the domestic power outlet, only during the positive phase of FS_Supply, through resistance R54, some of the current is taken from the circuit described above and flows through the flame to earth. The mean value of this current produces, via the equivalent series resistance of R61 and R69, a constant negative voltage which pushes the sinusoidal voltage downwards at the ends of condenser C16 mentioned above.

By appropriately sizing resistances R61 and R69, the result achieved is to interdict transistor Q4 even in the positive phase of FS_Supply, leaving I_Flame restricted to +5V. In the negative phase of FS_Supply, transistor Q4 interdicts itself because it is inversely polarized.

The result is that in the presence of a flame, signal I_Flame is constant and equal to +5V.

When the flame is present at the sparkplug electrode and the apparatus's plug is inverted with respect to the polarity of the domestic power outlet, nothing changes, because FS_Supply maintains its characteristics with respect to GND_IN.

Therefore, in the positive phase of FS_Supply, through resistance R54, some of the current is taken from the circuit described above and flows through the flame to earth. The mean value of this current produces, via the equivalent series resistance of R61 and R69, a constant negative voltage which pushes the sinusoidal voltage downwards at the ends of condenser C16 mentioned above.

The result is that in the presence of a flame, signal I_Flame is constant and equal to +5V.

Condenser C4, located between the Flame signal and GND_IN, serves to filter disturbances coming from the network. Resistance R20 protects the control logic from the disturbances coming from the network or from stage 70 Spark Activation.

In the device described, for example, six flame recognition networks have been implemented. By linking together all the Flame outputs of the various stages, it can be deduced whether at least one burner is in the condition of knob in gas delivery position and flame absent. This is achieved by linking all the outputs in a logical AND: in the presence of even a single burner without a flame and with the corresponding knob in the gas delivery position, the output of its capture stage, during the positive phase of FS_Supply, is placed at the value logical "0", which is reported on I_Flame independently of the status of the other outputs.

The electrical network in question has reaction times in modifying its output from the status of flame present to that of flame absent.

For the values used in the components it is a matter of a few hundred milliseconds due to the time constant given by (R48+R59+R61+R69)*C10.

Block 60 of Stage f) Control Logic

Figure 10:
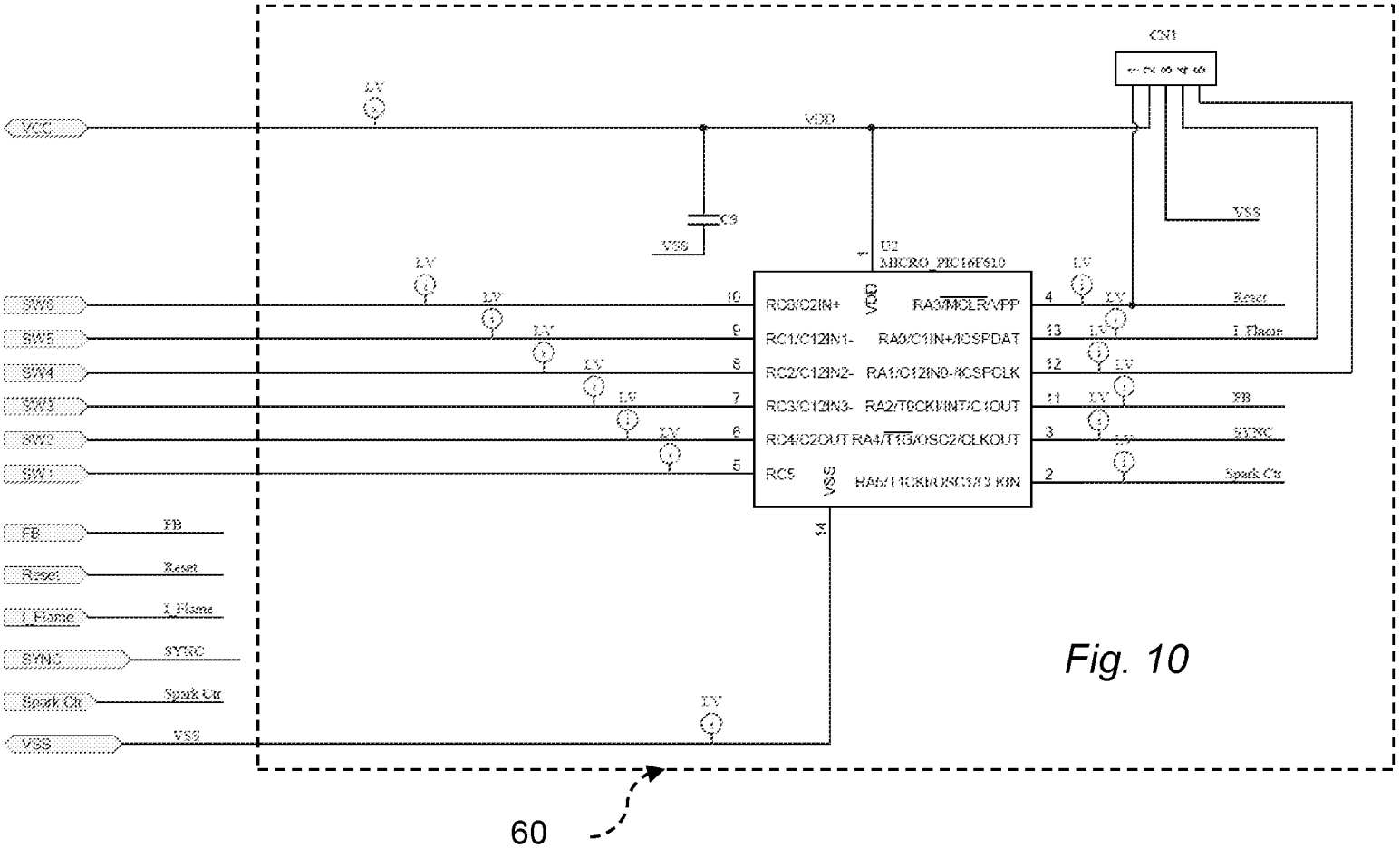
FIG. 10 (ELECTRICAL SCHEME OF CONTROL LOGIC) shows an embodiment of the electrical scheme of the circuit which realizes block f) Control logic.

The inventors have chosen to implement the control logic by means of a microcontroller, as illustrated in FIG. 10.

However, this choice does not represent a binding aspect. In fact, it would have been possible to realize the control logic by means of a combinatory logic or an ASIC (application-specific integrated circuit).

Connector CN1 makes it possible to program the microcontroller, which processes the inputs coming from SW1 up to SW6 to capture and interpret the status of the knobs.

By means of the input I_Flame, coming from stage 50, e) Flame Recognition, the control can establish whether at least one of the rings needs a flame at the burner and generate the appropriate signal on the output SparkCtr (logical "0").

Input FB comes from stage 70, g) Spark Activation, and is used on the control for managing the frequency of the sparks at the electrodes. In various embodiments, for example to contain costs, the sparkplugs which create the sparks can all be directed simultaneously.

The input SYNC is not used at the moment. In a future embodiment it could be useful to control thyristors, synchronizing them with the network frequency to prolong their useful life.

Block 70 of Stage g) Spark Activation

Figure 11:
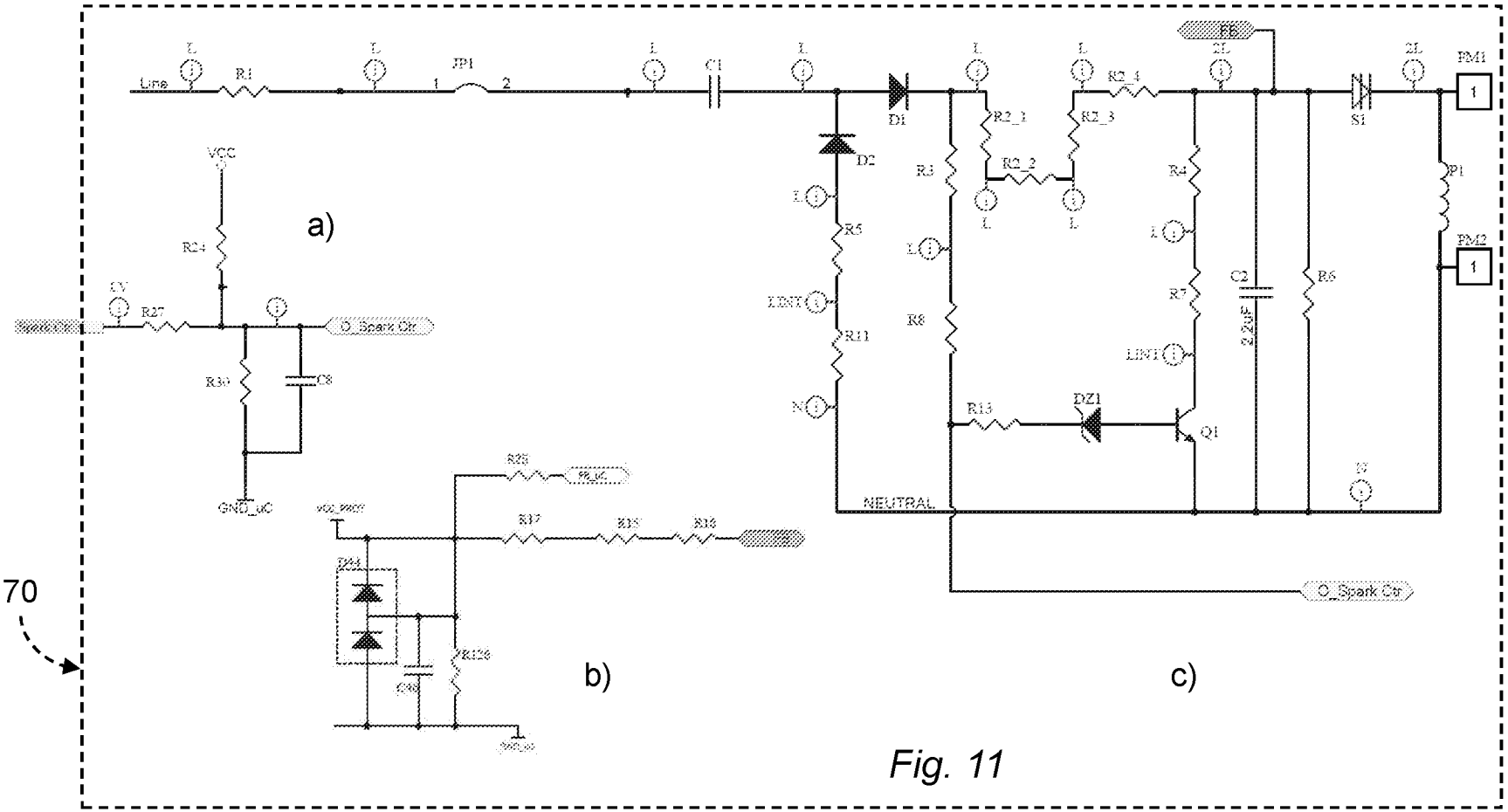
FIG. 11 (ELECTRICAL SCHEME OF SPARK ACTIVATION) shows an embodiment of the electrical scheme of the circuit which realizes block g) Spark activation.

With reference to FIGS. 11*a*, 11*b*, 11*c* the signal coming from the line is raised, through the following components: a resistance R1, a condenser C1, a diode D2, a resistance R5, a resistance R11, a diode D1, four resistances R2_1, R2_2, R2_3, R2_4, a condenser C2, of the appropriate value, in this case approximately 285V-369V. When the SIDAC (Silicon Diode for Alternating Current) S1 reaches its trigger voltage, 210V-230V, it short-circuits, transferring the stored energy from the condenser C2 to the primary circuit of the transformer.

The secondary circuit of the transformer has one end connected to the sparkplug electrode located close to the burner.

In various embodiments it is possible to connect a transformer with a primary and six secondary circuits to simultaneously direct the ignition of six rings, thus reducing manufacturing costs.

The transformer is made in such a way as to bring to 15 kV the voltage at the sparkplug electrode, bringing about the disruptive discharge necessary for the flame to be triggered.

The spark lasts about a tenth of a μS, as condenser C2 is discharged rapidly. The fact that the discharge of condenser C2 has taken place is reported to stage 60 f) Control Logic by means of signal FB picked up by condenser C2. Resistance R126 guarantees the logical 0 at the control logic stage when condenser C2 is kept discharged to avoid false indications of spark generation.

The network made up of resistances R3, R8, R13, diode DZ1, transistor Q1, and resistances R7, R4, consents or otherwise to the charge of condenser C2.

In particular, when the control logic directs the signal Spark Ctr to the value logical "0", condenser C2 is free to charge itself up to the value imposed by the SIDAC S1.

When the control logic directs the signal Spark Ctr to the value logical "1", or to high impedance, condenser C2 is kept discharged through the saturation of transistor Q1.

Resistance R27 protects the microcontroller from disturbances which may come from this stage; resistances R24 and R30 are mutually exclusive and serve to impose a known logical status when the control logic is not dealing with the output concerned (for example in the course of a reset).

Block 80 of Stage h) Electrodes

Figure 12:
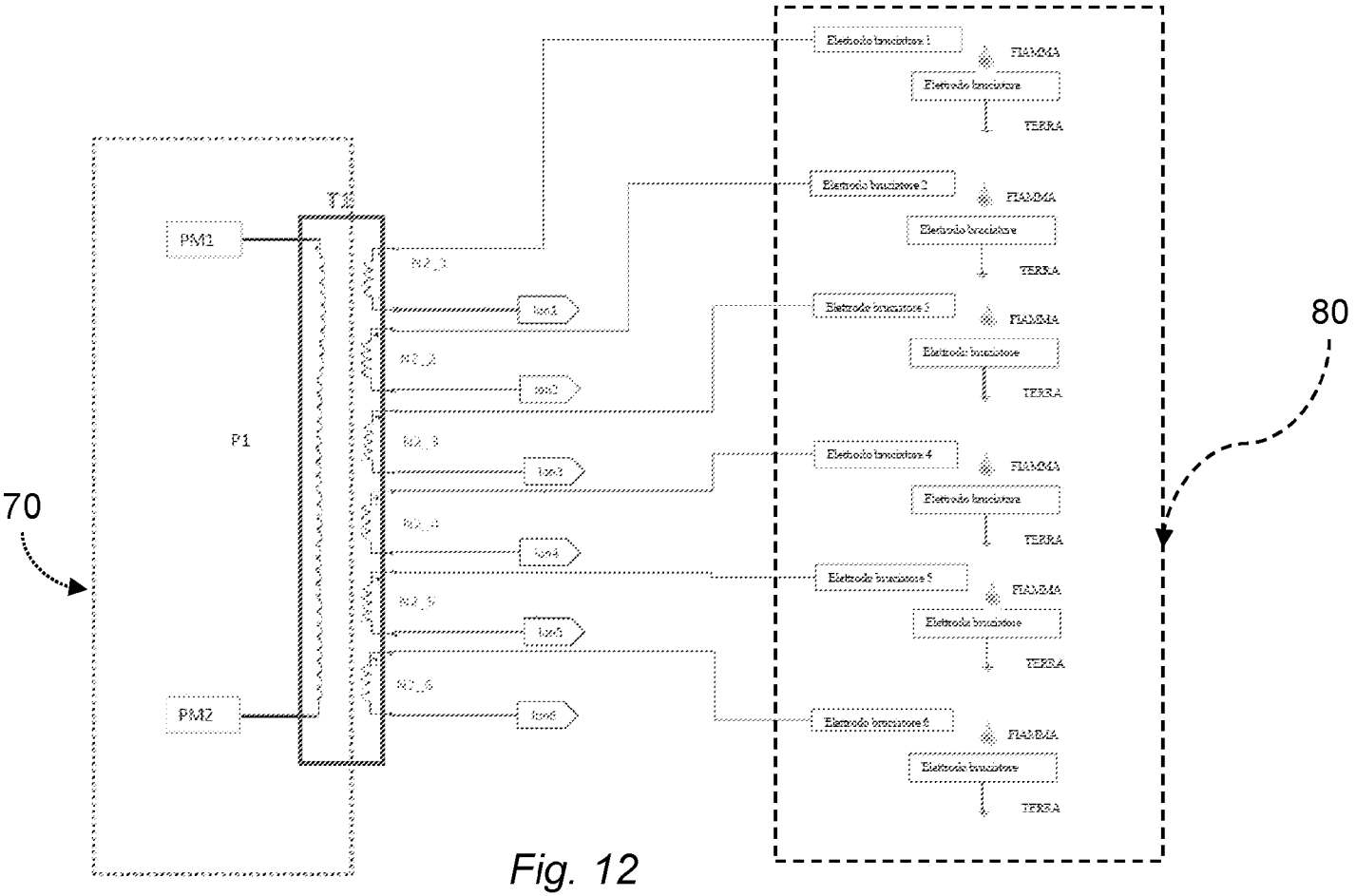
FIG. 12 (ELECTRICAL SCHEME OF ELECTRODES) shows an embodiment of the electrical scheme of the circuit which realizes block h) Electrodes, and FIG. 13 (FLOW CHART FLAME DISTURBED) shows a block scheme for managing a hidden flame.

With reference to FIG. 12, transformer T1 shown in block 70 g) Spark Activation is equipped with six secondary circuits capable of increasing the voltage up to about 15 kV.

Each ring on the cooktop is equipped with two electrodes, of which one is connected to earth (the burner) and the second is represented by a sparkplug.

The outputs of the six coils N2_1, N2_2, . . . N2_6, making up the secondaries of transformer T1, are connected to the electrodes of the corresponding sparkplugs.

When the primary of transformer T1 receives supply, there is a voltage in the secondary coils of about 15 kV, which brings about the spark and triggers the flame following delivery of the gas to the ring of the cooktop.

The shape and dimensions of the electrodes used for the disruptive discharge are not described because they can be made in any known manner.

The terminal on each secondary coil of the transformer T1 which is not connected to the sparkplug is used for reading the status of the flame on the corresponding ring. The signals Ion1, Ion2, . . . , Ion6 are then provided to block 50 e) Flame Recognition.

The signals mentioned are at high voltage and for this reason in the destination block, suppressors are used which stop the voltage at about 350-450V.

In various embodiments a method of discriminating a disturbed flame is also used.

The device and the method are independent of the number of rings on the cooktop.

The method basically consists of applying a delay to the production of sparks when passing from a condition of flame present on the burner to a condition of flame absent.

The delay is programmable and differentiable according to the requirements of the cooktop manufacturer.

Figure 13:
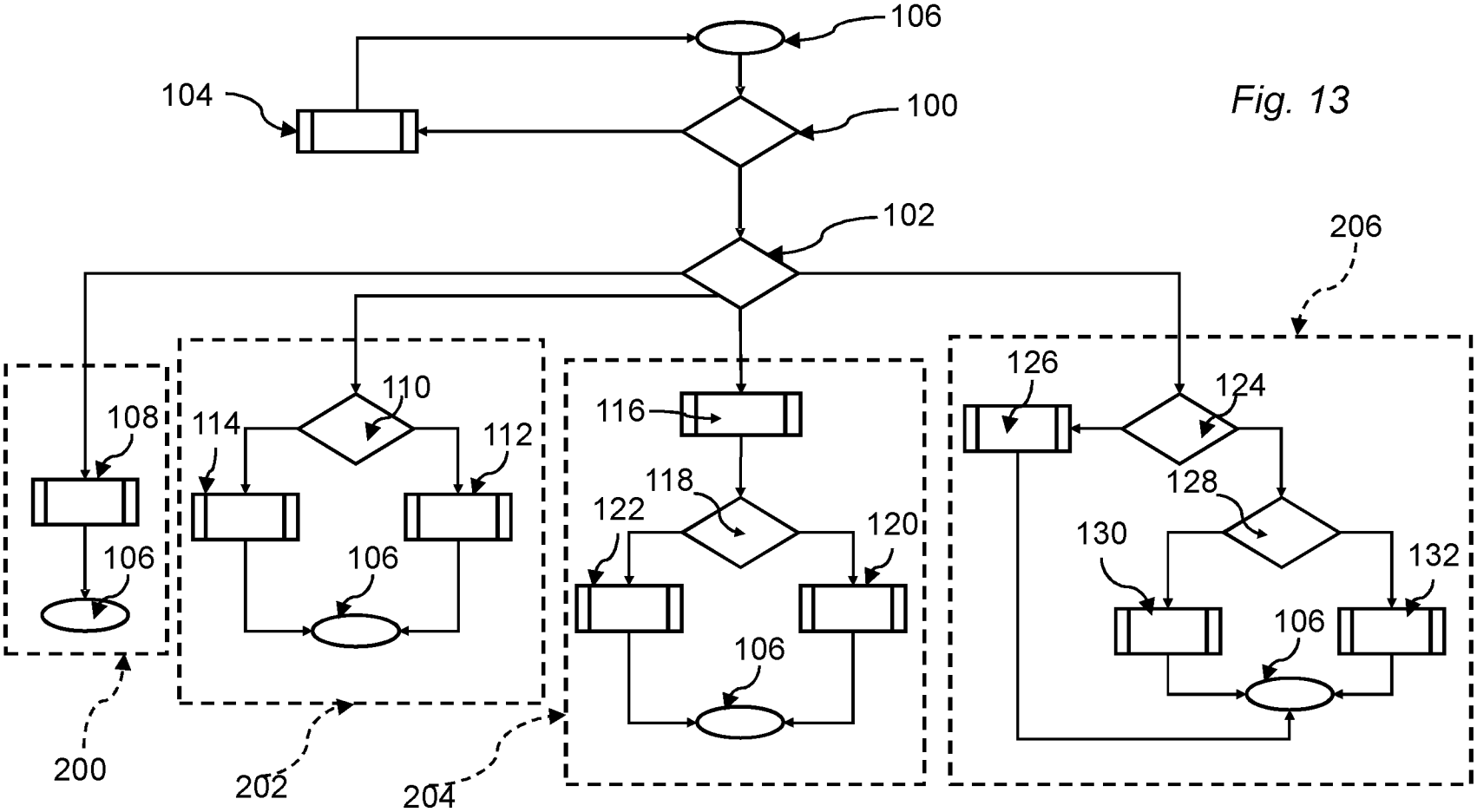

The method is described by means of the block diagram in FIG. 13.

The method described starts in a step 100 in which the position of the knob is checked. In the event of gas being delivered, the control continues to a step 102 with the flame control.

Conversely, if the knob is in the condition of interruption of the gas, the control continues with a step 104. In step 104 the control assigns: to the variable sparks control, the value SPARKS OFF, to the variable flame control, the value FLAME STOPPED, and it zeroes a "hidden flame" time counter, which measures the time from when the absence of flame was recognized.

At the end of step 104 the control returns to step 106, which is a waiting step or loop.

In step 102 relating to the flame control, the value of the variable flame control is checked and the control continues with one of the possible subsequent steps. In particular, in the event that the flame control is equal to FLAME STOPPED, the control continues in block 200 and in particular with a step 108 in which the variable flame control is set equal to FIRST FLAME. At the end of step 108 the control returns to the waiting step or loop 106.

In the event that the value of the flame control variable is equal to FIRST FLAME, the control continues to block 202 and in particular with a step 110 in which the status of the flame is checked. If the flame is absent, the control continues to a step 112 in which the spark control variable is set to the value SPARKS ON, and subsequently the control returns to the waiting step or loop 106. Conversely, in the event that the flame is present, the control continues to a step 114 in which the flame control variable is set equal to a value FLAME PRODUCED. In this case, too, the control then continues with the waiting step or loop 106.

However, in the event that the value of the flame control variable is equal to FLAME PRODUCED, the control continues to block 204 and in particular with a step 116 in which the sparks control variable is set equal to SPARKS OFF. In a subsequent step 118 the status of the flame is checked. If the flame is absent the control continues to a step 120 in which the hidden flame timer counter is zeroed and the flame control variable is set to the value HIDDEN FLAME. The control continues finally to the waiting step or loop 106. If the flame is present the control continues to a step 122 in which the hidden flame timer counter is zeroed, to then pass to the waiting step or loop 106.

Finally, in the event that the value of the flame control variable is equal to HIDDEN FLAME, the control continues to block 206 and in particular with a step 124 in which the status of the flame is checked. If the flame is present the control continues to a step 126 in which the hidden flame timer counter is zeroed and the flame control variable is set equal to the value FLAME PRODUCED. The control then continues to the waiting step or loop 106. In the event that the flame is absent, in a step 128 the timer of the hidden flame is checked. If the timer is less than or equal to a reference value, i.e. to the HIDDEN FLAME TIME, then the control continues to a step 130 to set the sparks control variable to the value SPARKS OFF. Vice versa, if the timer is greater than the above reference value, i.e. HIDDEN FLAME TIME, then the control continues to a step 132 in which: it zeroes the hidden flame timer, and assigns to the flame control variable the value FIRST FLAME and to the sparks control the value SPARKS ON.

In both cases from step 130 or from step 132, one goes back to the waiting step or loop 106.

The method described is a method of producing sparks at an almost constant frequency.

The firmware present in the control microcontroller makes use of the FB (feedback) signal coming from the condenser C2 of block 70 g) Sparks Activation to establish when a spark was created. The spark in fact produces a change of logical status on the FB input pin of the micro, sensitive to changes of status and source of interrupts in the firmware.

In this way the firmware can stop a timer started at the generation of a suitable signal (logical level "0") on output pin Spark Ctr.

The value obtained by the timer is subtracted from a reference time relative to the desired discharge frequency; the result is used to establish the waiting time for activating the signal Spark Ctr.

The control reduces its own energy consumption when the presence of the flame is not wanted.

The DC_Power signal is generated only when the gas knob is in delivery position.

This stage is replicated for each ring managed in the re-ignition control device.

If at least one knob is in gas delivery position, the signal DC_Power is activated.

From FIG. 7 it can be seen that in the absence of the signal DC_Power the stage in question does not produce any supply, with the control logic consequently being switched off.

In this way the control reduces its own current consumption when no knob is in gas delivery position, i.e. the presence of a flame is not required.

In a first embodiment, for each burner there is a flame igniting/re-igniting device. In this case rotation of the knob corresponding to a particular burner towards the open position in fact supplies the ignition device (i.e. connects the device to the source of electrical supply) and supplies the burner by delivering gas.

In a second embodiment, there is a single flame igniting/re-igniting device for a plurality of burners.

In this case a knob position detection circuit is necessary to detect the rotation of any knob towards the open position. When the detection circuit detects the opening of any knob, the ignition device receives the electrical supply and the delivery of gas is activated in the corresponding burner.

The ignition device here described can also be utilized for products which use gas burners connected to the electrical network.

Naturally, the details of execution and the forms of embodiment may vary, even significantly, compared with what is here illustrated purely by way of non-limiting example, without for this reason departing from the scope of protection. This protective scope is defined by the attached claims.

The invention claimed is:

1. A device for igniting/re-igniting the flame for a gas burner, for a cooktop, capable of receiving a supply voltage from a source of supply and configured for receiving a signal representing the presence of the flame, characterized in that said device for igniting/re-igniting the flame is configured for activating a circuit for activating a spark (70) and configured for generating sparks for igniting the flame when said signal representing the presence of the flame indicates absence of flame and for interrupting the generation of sparks when said signal indicates the presence of flame, characterized in that said device for igniting/re-igniting the flame comprises an anti-inversion circuit (40) configured for uncoupling said ignition/re-ignition device from the direction of insertion of a supply plug of said device into a domestic power outlet, rendering the device insensitive to the polarity adopted in the connection between said plug and said outlet;

the device further characterized in that said anti-inversion circuit (40) comprises a fixed resistive divider (R42, R45, R58, R63, R68, R71) providing a voltage divider sized in such a way as to ensure that the output (FS_Supply) provided through a third central terminal is a fixed ratio of the voltage difference between the signals (NEUTRAL, Line) which it receives as inputs on the two input terminals from said supply source, this being irrespective of the polarity adopted in the connection between said plug and said domestic outlet; wherein:

the cooktop comprises at least one knob for regulating the delivery of the gas, and characterized in that said ignition/re-ignition device comprises furthermore a circuit for capturing the position of the knob (20), characterized in that said knob is movable between an open position and a closed position, said circuit for capturing the position of the knob (20) being configured for generating a signal representing the position of the knob characterized in that said signal representing the position of the knob is capable of activating said circuit for activating the spark (70);

the device further comprises a control logic circuit (60) configured for interpreting and processing the signals coming from the circuit for capturing the position of the knob (20), from the circuit for detecting the flame (50), and from the circuit for activating the spark (70, FB), and is configured for controlling said circuit for activating the spark (70) depending on the processing of said signals received in input;

the control logic circuit (60) is capable of checking the operation of said circuit for activating the spark (70) to generate sparks only when: said signal generated by the circuit for capturing the position of the knob (20) indicates an open position for said at least one knob, and said signal generated by the circuit for detecting the flame (50) indicates absence of flame for a duration greater than a pre-established time; and the control logic circuit (60) is configured for recognizing and discriminating a condition of disturbed flame from a condition of absent flame, enabling the spark activation circuit (70) only when the flame is absent for a time greater than a pre-established time, so as to eliminate pointless flame re-ignitions caused by the condition of disturbed flame.

2. The device for igniting/re-igniting the flame according to claim 1, comprising a flame detection circuit (50), for detecting the presence of the flame, said flame detection circuit (50) being configured for generating said signal representing the presence or otherwise of the flame, characterized in that said anti-inversion circuit (40) comprises a resistive divider (R42, R45, R58, R63, R68, R71) sized in such a way as to ensure that the output (FS_Supply) provided in output through said third central terminal and carried in input to said flame detection circuit (50) is equal to half the supply voltage provided by said supply source.

3. The device for igniting/re-igniting the flame according to claim 1, characterized in that said circuit for activating the spark (70) is configured for generating sparks at substantially constant frequency and independent of the voltage and frequency of the supply source.

4. The device for igniting/re-igniting the flame according to claim 1, characterized in that said circuit for activating the spark (70) is configured for generating sparks at a frequency settable through the selection of the parameters of the circuits comprised in the device.

5. The device for igniting/re-igniting the flame according to claim 1, characterized in that the circuit for activating the spark (70) is configured for modifying the frequency of the sparks triggering the flame depending on the time spent in the attempt to trigger the flame, increasing the frequency as the time spent increases.

6. The device for igniting/re-igniting the flame according to claim 1, characterized in that said control logic circuit (60) processes said signal generated by the circuit for detecting the flame (50) and said signal generated by said circuit for activating the spark (70) for generating a signal capable of activating an electrode block (80).

* * * * *